US006538550B1

(12) United States Patent
Muench, Jr. et al.

(10) Patent No.: US 6,538,550 B1
(45) Date of Patent: Mar. 25, 2003

(54) HIGH AMPERAGE CURRENT LIMITING FUSE

(75) Inventors: Frank John Muench, Jr., Waukesha, WI (US); Gordon Thomas Borck, Waukesha, WI (US); Allen Leroy Johnson, Mukwonago, WI (US)

(73) Assignee: McGraw-Edison Company, Houston, TX (US)

( * ) Notice: Subject to any disclaimer, the term of this patent is extended or adjusted under 35 U.S.C. 154(b) by 272 days.

(21) Appl. No.: 09/240,712

(22) Filed: Feb. 2, 1999

(51) Int. Cl.[7] ..... H01H 85/08; H01H 85/12

(52) U.S. Cl. ..... 337/161; 337/228; 337/231; 337/295

(58) Field of Search ..... 337/228, 159, 337/161, 164, 186, 227, 229, 231, 260, 273, 290, 293, 295, 160, 297

(56) References Cited

U.S. PATENT DOCUMENTS

| | | | | | |
|---|---|---|---|---|---|
| 2,216,661 | A | * | 10/1940 | Dannenberg | 337/224 |
| 2,672,540 | A | * | 3/1954 | Dewey | 337/293 |
| 2,972,031 | A | * | 2/1961 | Cox | 337/229 |
| 3,012,121 | A | * | 12/1961 | Hicks | 337/160 |
| 3,145,282 | A | * | 8/1964 | Grzeczkowski | 337/229 |
| 3,189,712 | A | | 6/1965 | Kozacka | 200/120 |
| 3,251,968 | A | | 5/1966 | Cameron | 200/120 |
| 3,400,235 | A | | 9/1968 | Howard et al. | 337/229 |
| 3,569,891 | A | * | 3/1971 | Cameron | 337/290 |
| 3,571,775 | A | | 3/1971 | Kozacka | 337/161 |
| 3,599,138 | A | * | 8/1971 | Kozacka | 337/159 |
| 3,630,219 | A | | 12/1971 | Kozacka | 337/161 |
| 3,636,491 | A | | 1/1972 | Cameron | 337/244 |
| 3,777,370 | A | | 12/1973 | Wakui | 29/623 |
| 3,851,289 | A | * | 11/1974 | Kozacka | 337/161 |
| 3,863,187 | A | * | 1/1975 | Mahieu et al. | 337/162 |
| 3,962,666 | A | * | 6/1976 | Knapp, Jr. | 337/159 |
| 3,983,526 | A | * | 9/1976 | Koch | 337/278 |
| 4,017,817 | A | | 4/1977 | Ranzanigo | 337/290 |
| 4,058,786 | A | | 11/1977 | Gaia et al. | 337/293 |
| 4,125,819 | A | | 11/1978 | Jacobs, Jr. | 337/293 |
| 4,150,353 | A | * | 4/1979 | Huber et al. | 337/231 |
| 4,179,678 | A | | 12/1979 | Perreault | 337/293 |
| 4,419,651 | A | | 12/1983 | Leach | 337/159 |
| 4,506,249 | A | | 3/1985 | Huber et al. | 337/232 |
| 4,579,146 | A | | 4/1986 | Tsuru et al. | 137/627.5 |
| 4,638,283 | A | | 1/1987 | Frind et al. | 337/162 |
| 5,109,211 | A | * | 4/1992 | Huber | 337/158 |
| 5,274,349 | A | | 12/1993 | Hassler et al. | 337/171 |
| 5,355,111 | A | | 10/1994 | Haasler et al. | 337/248 |
| 5,361,058 | A | * | 11/1994 | Mosesian et al. | 337/163 |
| 5,559,488 | A | | 9/1996 | Hassler et al. | 337/158 |
| 5,670,926 | A | | 9/1997 | Ranjan et al. | 337/158 |
| 5,714,923 | A | | 2/1998 | Shea et al. | 337/159 |

* cited by examiner

*Primary Examiner*—Anatoly Vortman
(74) *Attorney, Agent, or Firm*—Fish & Richardson P.C.

(57) ABSTRACT

A high current fuse includes a housing with electrically-conductive caps attached at opposite ends. At least two winding supports are positioned in the housing, extending between the caps, and spaced from one another. Each winding support is wound by at least one electrically-conductive element. These elements are electrically connected to the caps.

28 Claims, 4 Drawing Sheets

HIGH AMPERAGE CURRENT LIMITING FUSE

TECHNICAL FIELD

The invention relates to current limiting fuses.

BACKGROUND

A fuse is a current interrupting device which protects an electrical circuit in which it is installed by creating an open circuit condition in response to excessive current (i.e., a current which exceeds the maximum allowable continuous current for the fuse). The current is interrupted when the element or elements which carry the current are melted by heat generated by the current. The fuse may contain materials, such as silica sand, which serve to reduce the time required for the fuse to interrupt the current.

A fuse's maximum allowable continuous current is a function of the size and number of current carrying elements in the fuse. One way to increase the maximum continuous current rating of a fuse is to place elements in parallel along the length of the fuse. A winding support may be used to hold the elements in place with proper element spacing. Typically, a minimum element length (e.g., 1.8 inches) per kilovolt of voltage is needed for proper fuse operation. Elements of sufficient length often are wound in a spiral manner to maintain a reasonable fuse length, since such spiral winding permits the element length to be longer than the fuse length.

An element winding support often includes two or more intersecting plates that intersect at their midsections. Typically, metallic plates are attached to the ends of the support. The fuse elements are attached to the plates in a way that provides essentially zero impedance. The plates in turn are secured to caps that fit over ends of a tube that holds and supports the internal structure of the fuse. The tube is filled with silica sand, which is compacted. Finally, the fill point of the fuse, which is typically a hole in one of the caps, is then sealed.

SUMMARY

A fuse includes a housing having ends to which electrically-conductive caps are attached. At least two winding support assemblies are positioned in the housing and extend between the caps. The winding supports are spaced from one another. Each winding support is wound by at least one electrically-conductive element that is electrically connected to the caps.

Embodiments may include one or more of the following features. For example, each winding support may include one or more additional electrically-conductive elements, each of which is wound around the winding support and electrically connected to the caps, so that, for example, each winding support carries two or more elements. A winding support may include two or more plates that act in concert to form multiple winding support surfaces. The fuse also may include additional winding supports and associated elements.

Each winding support may include a minor axis component and a major axis component that fit together to form the winding support. A width of the major axis component is greater than a width of the minor axis component to render the winding support asymmetrical. Each component may include at least one slotted opening that allows the components to fit together to form the winding support. The components also may include exterior nibs to retain the elements in place.

Each winding support may be made of, for example, mica, plastic, or a ceramic material. As an alternative to being formed from a pair of slotted plates, the winding support may be a single piece of plastic or ceramic material formed in the desired shape. For example, a plastic support may include three or more support arms. A winding support also may be made from non-interlocking plates that are clipped to end support plates.

Multiple winding supports may be formed using a single winding support structure. For example, two four-armed winding supports may be defined by a slotted central plate and a pair of cross plates. The slotted central plate if defines two arms of each of the winding supports, while each cross plate defines the other two arms of one of the winding supports.

Typically, the winding supports are non-coaxial. The winding supports may extend in directions generally parallel to a longitudinal central axis defined by the housing. The winding supports also may be offset from the central axis. The housing may be cylindrical in shape, and may contain silica sand. The housing may contain a pair of plates, with each cap physically connected to a plate and each plate physically connected to the winding supports.

By using multiple winding supports, the fuse is able to carry two to three times more current than may be carried by a traditional fuse employing a housing of the same size.

Other features and advantages will be apparent from the following description, including the drawings, and from the claims.

DETAILED DESCRIPTION

Figure 1:
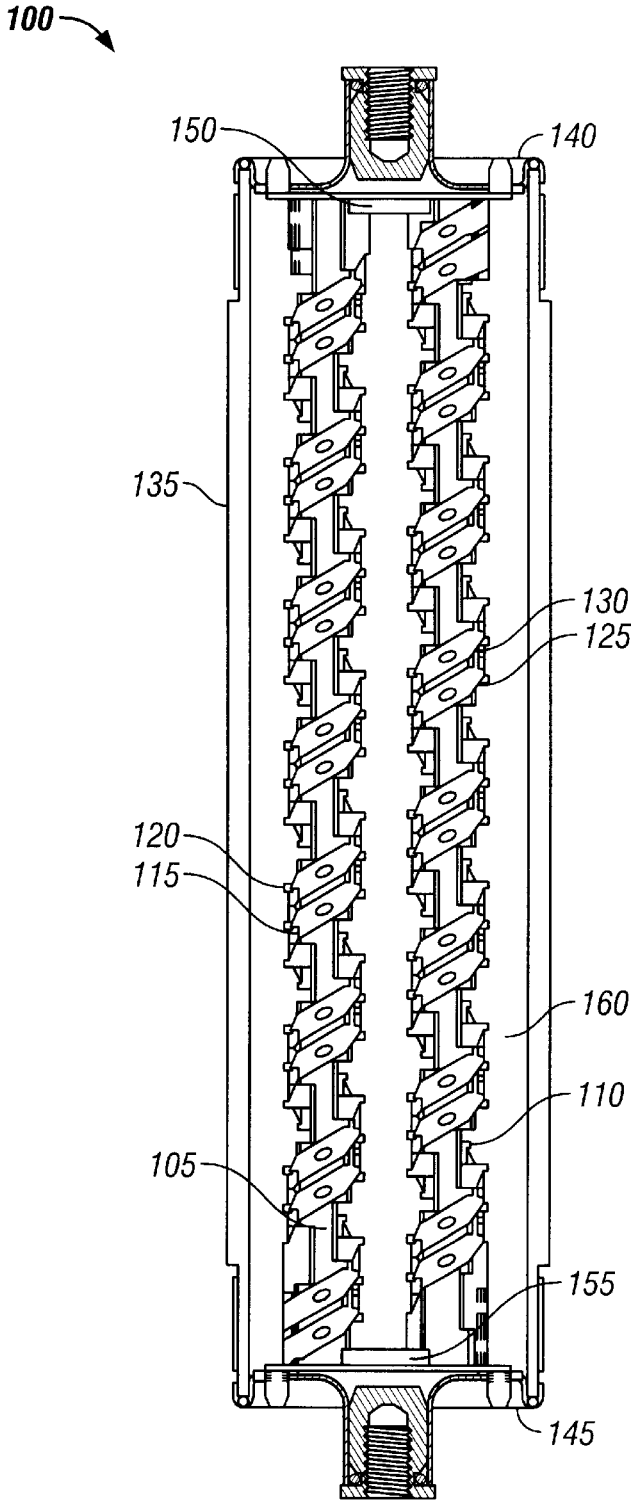
FIG. 1 is cutaway side view of a current limiting fuse with two winding supports.

Referring to FIG. 1, a current limiting fuse 100 is designed to handle larger currents than are handled by conventional fuses of the same physical size. To this end, the current limiting fuse 100 includes a pair of winding, supports 105 and 110. Each winding support includes a pair of metal elements (115, 120 on 105; 125, 130 on 110) wound as spirals on the winding supports. The elements 115–130 create an open circuit in response to excess current.

The winding supports 105, 110 are contained in a cylindrical tube 135 that is sealed on each end by caps 140, 145.

The caps 140, 145 are connected to plates 150, 155, which are mounted to the ends of the winding supports 105, 110. The caps 140, 145 are also electrically connected to the elements 115–130. Inside the cylindrical tube 135, the elements 115–130 and the winding supports 105, 110 are embedded in silica sand 160.

Electrical current passes through the first cap 140, along the elements 115–130 inside the fuse 100, and into the second cap 145 to exit from the fuse 100. Structurally, the caps 140, 145 provide support to the plates 150, 155 which in turn support the winding supports 105, 110 and the elements 115–130.

Each element 115–130 must be large enough to carry a desired continuous current, but small enough to interact with the silica sand 160 to quickly interrupt fault currents. Though a pair of elements are shown with a pair of winding supports, other numbers of elements and winding supports may be used.

In the fuse 100, a fault occurs when a current higher than the fuse's continuous current rating is applied to the fuse. When a fault occurs, the elements melt and create an open circuit condition. While the elements are in the process of melting, an arc passes across the opening in the elements. This arc interacts with the silica sand to form a glassy fulgarite. The glassy fulgarite is nonconductive, and its formation along the path of the arc quickly eliminates all current flow along that path. Thus, in summary, when an excess current is applied to the fuse 100, the elements 115–130 melt to create an open circuit condition. The silica sand 160, by creating glassy fulgarite to block arc paths, decreases the time required to achieve the open circuit condition relative to fuses that do not include silica sand.

The fuse 100 increases the total cross sectional area of the elements 115–130 through the use of multiple winding supports 105, 110 with each winding support holding and positioning multiple elements. The multiple winding supports 105, 110 are placed in parallel within the fuse tube 135. This significantly increases the continuous current rating of the fuse.

Well understood rules govern the placement of the elements 115–130 on the winding supports 105, 110. Each element must be separated from other elements when it is wound on a winding support. This separation must be large enough so that a fault current does not bridge the gap between adjacent elements. Such bridging would shorten the current path and reduce the effective resistance of the fuse. As the resistance of the fuse is reduced, the ability of the fuse to interrupt currents which exceed the capability of the fuse is substantially reduced.

The fuse elements 115–130 also must be spaced far enough from the tube wall 135 to allow the heat evolved during the interruption process to be dissipated harmlessly. If the elements 115–130 are too close to the tube wall 135, they can char the surface of the tube wall 135, resulting in structural failure and/or cracking due to carbonization. When a ceramic tube is used and elements are placed too close to the tube, the tube may shatter as a result of the heat release and thermal shock.

FIG. 1 shows a fuse 100 with a two inch diameter cylindrical tube 135 with two winding supports 105, 110 mounted in parallel. Relative to fuses employing a single winding support, the use of two winding supports 105, 110 allows two times the number of elements to be placed in the same tube. Using a separate winding support for each group of elements also reduces problems associated with maintaining the separation between the elements in operation and in filling the fuse with silica sand, and allows control and maintenance of the positioning needed for proper operation. The end plates 145, 150 support and position the individual winding supports. Fixing the elements 115–130 on the winding supports 105, 110 prevents movement of the elements. Such movement could adversely affect operation of the fuse.

Figure 2:
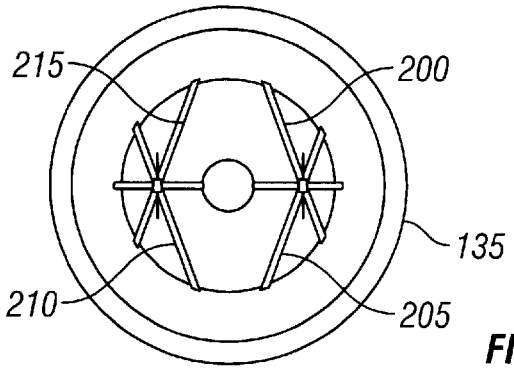
FIG. 2 is an end view of the current limiting fuse of FIG. 1.
Figure 3:
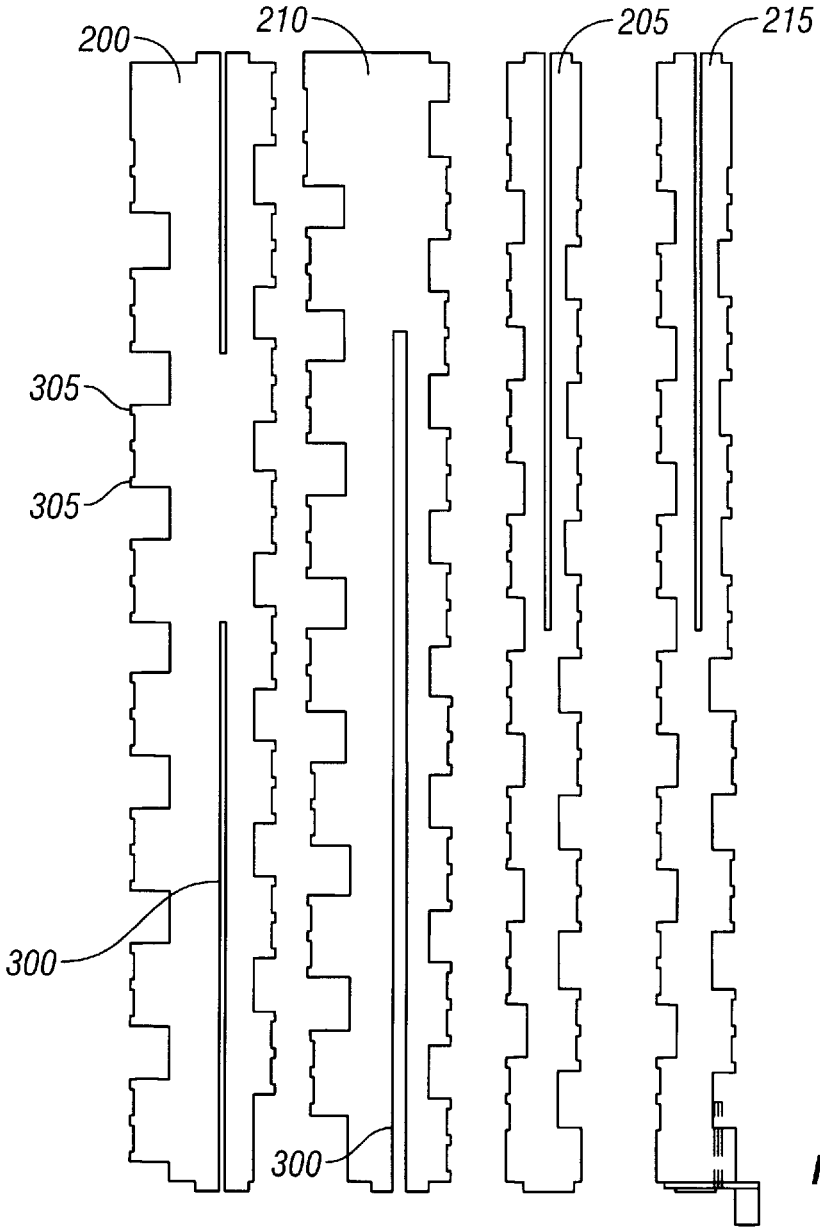
FIG. 3 is a side view of a set of support members used in the fuse of FIG. 1.

Referring to FIGS. 2 and 3 the winding support may be asymmetrical. The winding support includes two or more support members. For example, as shown, two support members are used to form each winding support. The two support members 200, 205 of support 105 and 210, 215 of support 110 may be configured to increase the amount of current conducting material within the fuse, resulting in an increase in the overall current carrying capacity of the fuse. As shown in FIG. 3, each of the support members 200–215 includes a slit 300. The support members may be secured by an end clip (not shown) that holds the support members in position relative to one another. Each edge of the support members 200–215 has a series of raised nibs 305 that hold the elements 115–130 in place and maintain the required spacing between elements. The end clip also has a clip mechanism to secure the elements 115–130 during winding on the winding supports 105, 110 before they are integrated into the end plates 150, 155.

The end plates 150, 155 are made from a conductive metal such as copper. The plates 150, 155 have holes or slots to locate and secure the winding supports 105, 110. After the winding supports 105, 110 are placed on the end plate 150 on one side of the fuse, and the second end plate 155 is added, the elements 115–130 are soldered, brazed, or welded to the end plates 150, 155. The end plates 150, 155 have tabs (not shown) that mate with the caps 140, 145 on the ends of the fuse tube 135. The plates 150, 155 and caps 140, 145 are soldered together or have a mechanical fit, so that current can flow from the cap to the plate, from the plate to the elements, through the elements, and through the other plate and cap.

A winding assembly includes the winding support and its associated elements. The winding assemblies can be made as needed and stored. The ampere rating of the entire fuse can be set by assembling one, two, three, four, five, six, seven or more of these winding assemblies in the end plates/cap/tube structure. This allows simplified, automated and improved manufacture of the winding assemblies. In effect, the fuse is a modular group of subassemblies.

Figure 4:
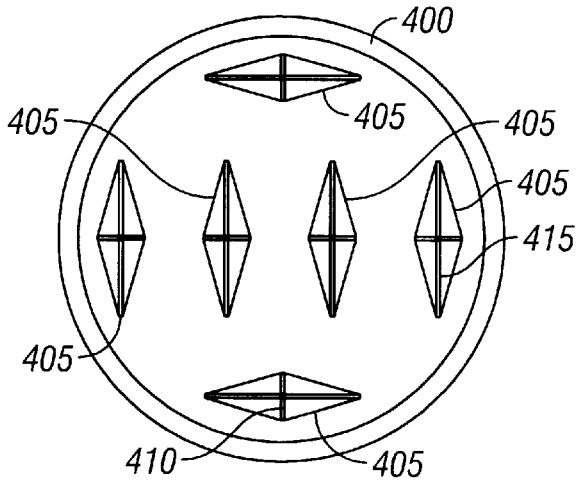
FIG. 4 is an end view of a current limiting fuse with six winding supports.
Figure 5:
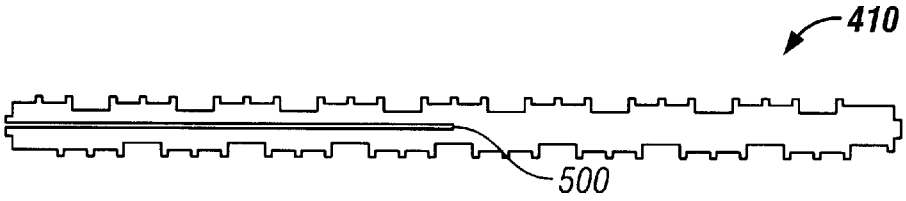
FIG. 5 is a side view of the minor axis component used in each winding support of the current limiting fuse of FIG. 4.
Figure 6:
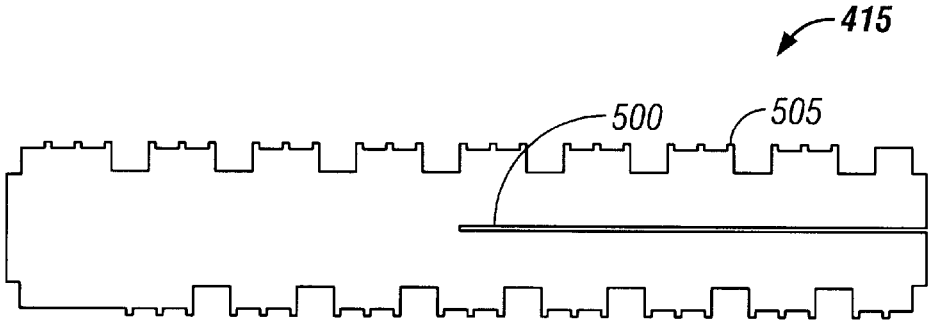
FIG. 6 is a side view of the major axis component used in each winding support of the current limiting fuse of FIG. 4.

Referring to FIGS. 4–6, another fuse 400 uses six parallel support windings 405 to support the elements. Each winding support 405 includes a minor axis component 410 and a major axis component 415. The components 410, 415 each include a slot 500 that serves to secure the components together. Each edge of the components has a series of raised nibs 505 that hold the elements in place and maintain element location and the required spacing between elements. End clips (not shown) are again used to secure the components together. With this arrangement, six parallel supports, each having two elements, may be positioned in a three and a quarter inch diameter tube, while maintaining the required lengths and separations, to provide a fuse capable of carrying 140% to 180% of a conventionally designed fuse which might permit only five, or at most six, individual elements.

Figure 8:
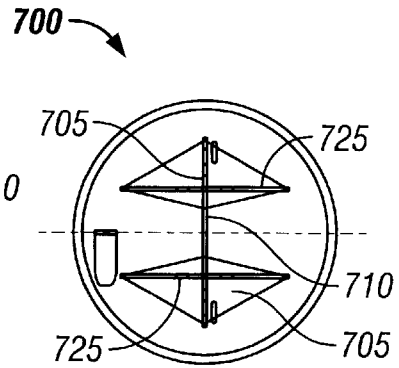
FIG. 8 is an end view of the slotted-plate structure of FIG. 7.
Figure 7:
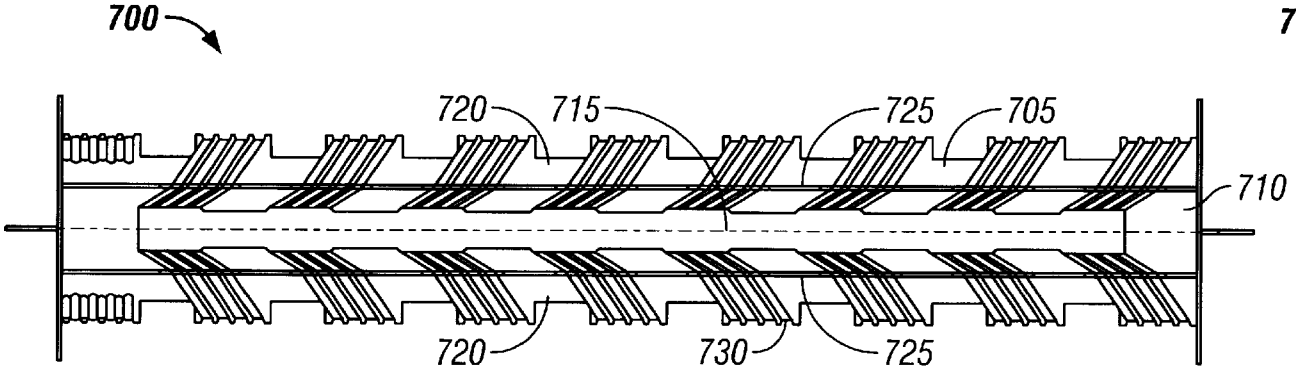
FIG. 7 is a side view of a slotted-plate structure for providing a pair of winding supports.

Referring to FIGS. 7 and 8, a structure 700 for providing a pair of winding supports 705 includes a central, slotted plate 710. A slot 715 divides the plate into two portions 720, each of which provides two shorter arms of a winding support. Cross plates 725 are located at opposite ends of the central plate 710. Each cross plate 725 provides the two longer arms of a winding support. Each winding support is wound with four fuse elements 730.

Figure 9:
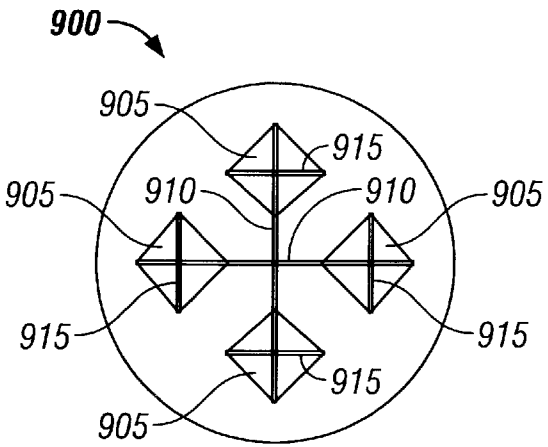
FIG. 9 is an end view of a slotted-plate structure for providing four winding supports.

Referring to FIG. 9, a structure 900 for providing four winding supports 905 includes a crossed pair of slotted plates 910. Each slotted plate 910 provides two arms of a winding support at each of its ends. Cross plates 915 at opposite ends of the slotted plates provide the other arms of the winding supports.

Other embodiments are within the scope of the following claims.

What is claimed is:

1. A high current fuse comprising:

a housing;

a first electrically-conductive cap attached to a first end of the housing;

a second electrically-conductive cap attached to a second end of the housing;

at least two winding supports positioned in the housing, extending between the caps, and spaced from one another;

at least one electrically-conductive element wound around a first one of the winding supports and electrically connected to the caps; and at least one electrically-conductive element wound around a second one of the winding supports and electrically connected to the caps;

wherein at least a portion of both of the two winding supports is defined by a single structure.

2. The high current fuse of claim 1, further comprising at least two additional electrically-conductive elements, wherein each element is wound around one of the winding supports and electrically connected to the caps.

3. The high current fuse of claim 1, further comprising:

at least one additional winding support positioned in the housing; and at least one additional electrically-conductive element wound around the additional winding support and electrically connected to the caps.

4. The high current fuse of claim 1, wherein:

each winding support includes a minor axis component and a major axis component that fit together to form the winding support, and a width of the major axis component is greater than a width of the minor axis component to render the winding support asymmetrical.

5. The high current fuse of claim 4, wherein the minor axis component and the major axis component each include at least one slotted opening that allows the components to fit together to form the winding support.

6. The high current fuse of claim 5, wherein each component includes exterior nibs to retain the elements in place.

7. The high current fuse of claim 1, wherein each winding support is formed as a single piece of material having three or more arms.

8. The high current fuse of claim 1, wherein the housing defines a longitudinal central axis and the winding supports extend in directions generally parallel to that axis.

9. The high current fuse of claim 8, wherein the winding supports extend in directions offset from the central axis.

10. The high current fuse of claim 1, wherein the housing is generally cylindrical in shape.

11. The high current fuse of claim 1, wherein the housing contains silica sand.

12. The high current fuse of claim 1, further comprising a pair of plates, wherein each cap is physically connected to a plate and each plate is physically connected to the winding supports.

13. The high current fuse of claim 1, wherein the portion of both of the two winding supports is defined by a slotted central plate.

14. The high current fuse of claim 13, wherein:

a first winding support is defined by a first cross plate and a portion of the slotted central plate on a first side of a slot of the slotted central plate, and a second winding support is defined by a second cross plate and a portion of the slotted central plate on a second side of the slot of the slotted central plate, the second side being positioned opposite the first side.

15. A high current fuse comprising:

a housing defining a central longitudinal axis;

a first electrically-conductive cap attached to a first end of the housing;

a second electrically-conductive cap attached to a second end of the housing;

at least two non-coaxial winding supports positioned in the housing spaced from one another and extending between the caps;

at least one electrically-conductive element wound around a first one of the winding supports and electrically connected to the caps; and at least one electrically-conductive element wound around a second one of the winding supports and electrically connected to the caps;

wherein at least a portion of both of the two non-coaxial winding supports is defined by a single structure.

16. The high current fuse of claim 15, wherein the at least two non-coaxial winding supports extend between the caps in directions generally parallel to the central longitudinal axis.

17. The high current fuse of claim 16, wherein the at least two non-coaxial winding supports extend between the caps in directions generally parallel to, and offset from, the central longitudinal axis.

18. The high current fuse of claim 15, further comprising at least two additional electrically-conductive elements, wherein each element is wound around one of the winding supports and electrically connected to the caps.

19. The high current fuse of claim 15, further comprising:

at least one additional winding support positioned in the housing spaced from the other winding supports and extending between the caps in directions generally parallel to, and offset from, the central longitudinal axis; and at least one additional electrically-conductive element wound around the additional winding support and electrically connected to the caps.

20. The high current fuse of claim 15, wherein:

each winding support includes a minor axis component and a major axis component that fit together to form the winding support, and a width of the major axis component is greater than a width of the minor axis component to render the winding support asymmetrical.

21. The high current fuse of claim 20, wherein the minor axis component and the major axis component each include at least one slotted opening that allows the components to fit together to form the winding support.

22. The high current fuse of claim 21, wherein each component includes exterior nibs to retain the elements in place.

23. The high current fuse of claim 15, wherein each winding support is formed as a single piece of material having three or more arms.

24. The high current fuse of claim 15, wherein the housing is generally cylindrical in shape.

25. The high current fuse of claim 15, wherein the housing contains silica sand.

26. The high current fuse of claim 15, further comprising a pair of plates, wherein each cap is physically connected to a plate and each plate is physically connected to the winding supports.

27. The high current fuse of claim 15, wherein the portion of both of the two winding supports is defined by a slotted central plate.

28. The high current fuse of claim 27, wherein:

a first winding support is defined by a first cross plate and a portion of the slotted central plate on a first side of a slot of the slotted central plate, and a second winding support is defined by a second cross plate and a portion of the slotted central plate on a second side of the slot of the slotted central plate, the second side being positioned opposite the first side.

* * * * *